US006618973B2

(12) United States Patent
Nelson

(10) Patent No.: US 6,618,973 B2
(45) Date of Patent: Sep. 16, 2003

(54) BANNER HOLDER

(76) Inventor: Ned H. Nelson, 1021 92nd Ave., NE Bellevue, WA (US) 98004

( * ) Notice: Subject to any disclaimer, the term of this patent is extended or adjusted under 35 U.S.C. 154(b) by 49 days.

(21) Appl. No.: 09/858,233

(22) Filed: May 15, 2001

(65) Prior Publication Data

US 2002/0170217 A1 Nov. 21, 2002

(51) Int. Cl.[7] ..... G09F 17/00
(52) U.S. Cl. ..... 40/604; 40/607
(58) Field of Search ..... 40/604, 603, 602, 40/607, 611; 160/378

(56) References Cited

U.S. PATENT DOCUMENTS 3,034,242 A * 5/1962 Gold ..... 40/604
3,310,899 A * 3/1967 Hart et al. ..... 40/604
3,495,346 A 2/1970 Gilmoure
3,550,297 A * 12/1970 Friedrichsen ..... 40/603
3,581,420 A 6/1971 Mollet et al.
3,609,894 A 10/1971 Miller
3,675,356 A 7/1972 Gilmoure
3,726,035 A 4/1973 Bower et al.
3,982,345 A 9/1976 Coleman
4,095,360 A * 6/1978 Dinan et al. ..... 40/603
4,730,803 A 3/1988 Hillstrom
4,880,195 A * 11/1989 Lepley ..... 248/219.3
5,263,675 A 11/1993 Roberts et al.
5,335,889 A 8/1994 Hopkins et al.
5,428,913 A 7/1995 Hillstrom
6,192,611 B1 * 2/2001 Molla ..... 160/378
6,493,973 B1 * 12/2002 Nelson ..... 40/607

* cited by examiner

*Primary Examiner*—William L. Miller
(74) *Attorney, Agent, or Firm*—David L Garrison; Garrison & Assoc. PS

(57) ABSTRACT

An improved banner holder and method for exchangeable signs, flags, and other banners with extreme structural simplicity and a minimum moving parts. The banner holder comprises a support, at least one mounting members, an interchangeable brace to hold the banner, and an apparatus to automatically reduce wind loads on the banner. The banner is mounted on a brace. The brace engages one or more unique mounting members in such fashion as to make the brace, and the banner mounted on it, easily mountable, removable, and replaceable. The apparatus further protects the banner and banner holder from wind damage by automatically reducing the effective area of a banner in response to wind loading.

19 Claims, 4 Drawing Sheets

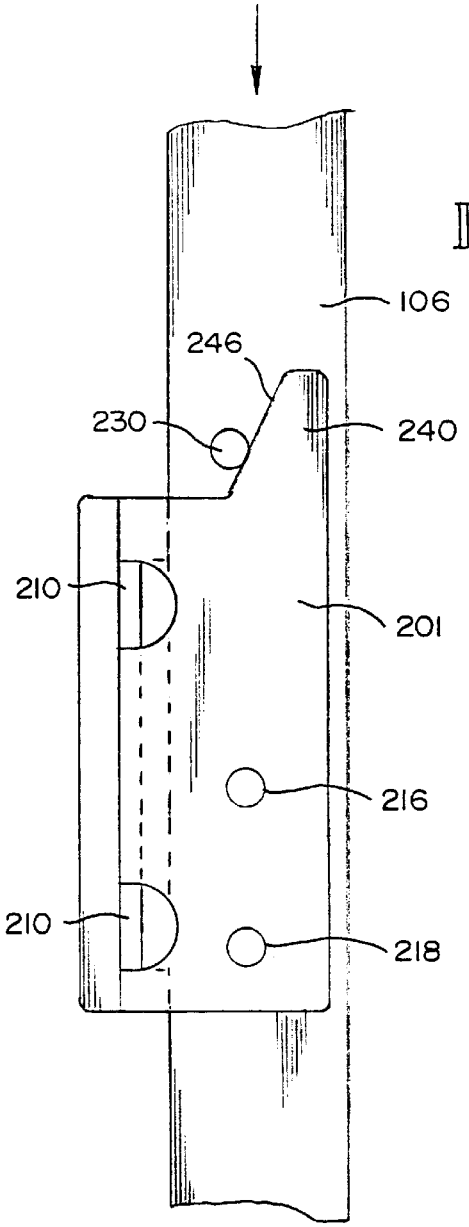
FIG. 4
FIG. 5
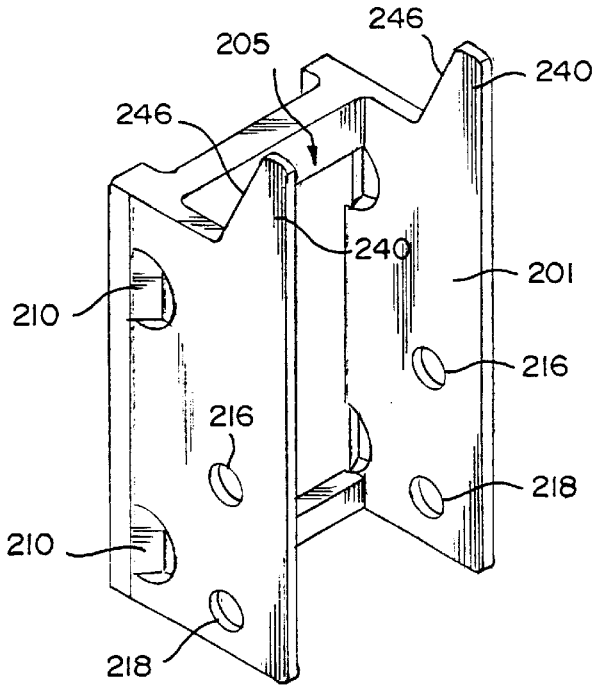

BANNER HOLDER

TECHNICAL FIELD

The invention relates to display banners, and more particularly to an improved banner and sign display device.

BACKGROUND OF THE INVENTION

It has long been human practice to display pictures and other information on banners, and to mount the banners on structures for convenience in viewing. Frequently banners have been mounted on free-standing or otherwise dedicated structures which hold them up in straight, flat, or unfolded condition to make them easier to read and see. It is of critical importance that such banner holding structures be sturdy, durable, and easy and simple to use and erect. It is convenient if such structures allow banners to be installed, removed, and replaced easily.

A number of attempts at making simple and effective banner holders have been tried. While each represents an advance, they are also each more complicated to construct and less simple to install and/or remove than is necessary. For example, U.S. Pat. Nos. 5,335,889 to Hopkins et al.; 5,263,675 to Roberts et al,; 5,428,913 to Hillstrom; 3,310, 899 to Hart et al.; 3,609,894 to Miller; 3,726,035 to Bower et al.; and 3,675,356 and 3,495,346 to Gilmoure all disclose banner suspension systems requiring access to the upper end of the banner and therefor some ladder or lift for access during installation. The systems they disclose are relatively complicated and permanent, and require somewhat complex work to replace or remove.

Another attempt is shown in U.S. Pat. No. 3,581,420 to Mollet et al., which discloses a pole sign construction in which the upper end of a pole sign is hung from simple hooks attached to a pole support member. Again, hanging of the pole sign thus requires access to the upper end of the sign, as for example by means of a ladder or hydraulic lift.

U.S. Pat. No. 4,730,803 to Hillstrom discloses a ground access elevated pole banner which reduces the need for ladders or hydraulic lifts but relies upon a relatively complicated track system secured to the side of a pole support member.

Because banners are held taut for display purposes, they act like sails in the wind and can generate substantial force and flap. The force generated and the flapping is detrimental to the banners and their support structure. The wind force can result in tearing, fraying, or dislodging of the banner, and bending or destruction of the structure holding the banner.

Thus although several systems have been disclosed, there remains a need for a simple, secure, and effective means for suspending and displaying banners, flags, and other large means for exhibiting information. There is a further need for systems which allow easy installation, removal, and replacement of banners for viewing. There is also a need for a simple and effective means to hold the banners taut while providing a means for the banner to spill wind and diminish the force generated by the wind.

DISCLOSURE OF THE INVENTION

Accordingly, it is an object of the invention to provide a simple, secure, and effective means for suspending and displaying banners, flags, and other large means for exhibiting information. It is a further object of the invention to provide such systems which allow for the easy installation, removal, and replacement of such banners for viewing. It is further an object of the invention to provide a simple, secure, and effective means for maintaining tension on banners, flags, and other large means for exhibiting information, while providing a means to spill wind and diminish the force generated by the wind.

The invention provides such a system. The invention represents a novel and improved banner holder for displaying easily exchangeable banners, signs, flags, and other means for exhibiting information with extreme structural simplicity and a minimum of moving parts. In general, the banner holder according to the invention comprises a support member, at least one mounting member, and an interchangeable brace adapted to hold the banner. The brace is adapted to engage the mounting member in such fashion as to make the brace, and the banner mounted on it, easily mountable, removable, and replaceable. The banner itself is held between two parallel frame members. One frame member is mounted in a fixed position to the brace, and the other frame member is mounted on a moveable mount on the brace that is tensioned and held taut by an elastic member. When the banner is subject to wind loads, the elastic member allows the frame member mounted on the moveable mount to move toward the fixed frame member, thus spilling the wind, reducing the effective area of the banner subject to the wind, and thus diminishing the force on the banner generated by the wind. Applicant's U.S. application Ser. No. 09/452,509, filed Dec. 1, 1999, is incorporated herein by reference.

In its most basic form, the apparatus aspect of the invention provides a banner support assembly for holding a banner in a display position, the support assembly comprising a support member, first and second mounting members, a brace, a banner holder mounted to the brace that retains a banner and to hold the banner spread out for display, typically in a flat or quasi-flat (e.g., a smoothly curved) condition for viewing or reading. The brace has first and second ends, each of which is adapted to engage one of said mounting members, and the first and second mounting members disposed upon the support member at a distance from each other sufficient to allow the mounting members to be simultaneously and releasably engaged by the brace ends, such that said brace may be supported on said support member and thereby hold said banner in a display position. The mounting and removal of banners from a structures of this type, and in particular of each of the types described herein, in the manner herein described, is remarkably simple. Yet the system provides a very secure mounting well adapted to the efficient display of banners, etc. Moreover, by supplying a banner support assembly with a series of two or more braces, each with an attached banner, the replacement or rotation of banners and their associated messages, etc., may be very quickly and easily accomplished.

The banner holder apparatus also provides a means to hold the banner taut and to spill wind loads. The banner support assembly comprises a pair of frame members which attach to the banner on opposite sides and hold it in display position. A first frame member is attached to brace in a fixed position, and a second frame member is attached to a moveable mount that moves in a channel in the brace. The banner is tensioned and held taut by an elastic member that draws the moveable mount and second frame member away from the first frame member. Wind loads on the banner are relieved by the deformation of the elastic member and the movement of the moveable mount and the second frame member toward the first frame member.

A preferred embodiment of the apparatus aspect of the invention comprises at least one formed mount with a tapered structure to removably retain the brace and the banner support assembly mounted to the brace. At least one formed mount is attached to the support structure. The brace adapted to hold the banner has a guide pin for each formed mount employed. As the brace is inserted into the receiver of the mount, the guide pin contacts a guide face on a tapered structure formed in the mount. The action of the guide pin against the guide face draws the banner holder toward and against the support structure, thereby securing and removably retaining the banner holder against the support structure. The guide face is of sufficient length that the brace is fully secured against the support member before the guide pin reaches the end of the guide face. The brace is removed from the formed mount by reversing the insertion process. The banner holder can be optionally retained by a retention apparatus, and can be locked in place to prevent unwanted removal. Additional mounts can be used in this embodiment as necessary for the application, these mounts can be of any type, including the formed mount. The brace can engage the formed mount at any point along the length of the brace because the point of engagement is not limited to the brace ends. The brace of this embodiment is typically a rectangular tube or any other cross section that provides torsional rigidity and engages the receiver portion of the formed mount.

The banner support apparatus of the preferred embodiment of the apparatus aspect of the invention comprises holding the banner between two parallel frame members. The first frame member is attached to the brace, and the second frame member is attached to a moveable or slidable mount that moves along the brace. An elastic member is attached at one end to the moveable mount and the other end is attached to the brace such as to draw the second frame member away from the first frame member and thus tension and hold the banner taut. The degree of tension on the banner is controlled by the characteristics and location of elastic member, which is selected to hold the banner taut while allowing the banner respond to wind loads. Under wind loading, the force of the wind on the banner increases the load on the elastic member which stretches and allows the second frame member to move toward the first frame member, thus spilling wind and reducing the effective area of the banner subject to the wind.

As will appear from the disclosure herein and in the Figures, banner holders according to the invention provide an extremely simple, secure, and effective means for suspending and displaying banners, flags, and other large means for exhibiting information. They also provide systems which allow for the easy installation, removal, and replacement of banners for viewing.

BRIEF DESCRIPTION OF THE DRAWINGS

FIG. 4 is a side view of the brace placed in the formed mount.

FIG. 5 is a perspective view of the formed mount.

BEST MODE OF CARRYING OUT THE INVENTION

Figure 1:
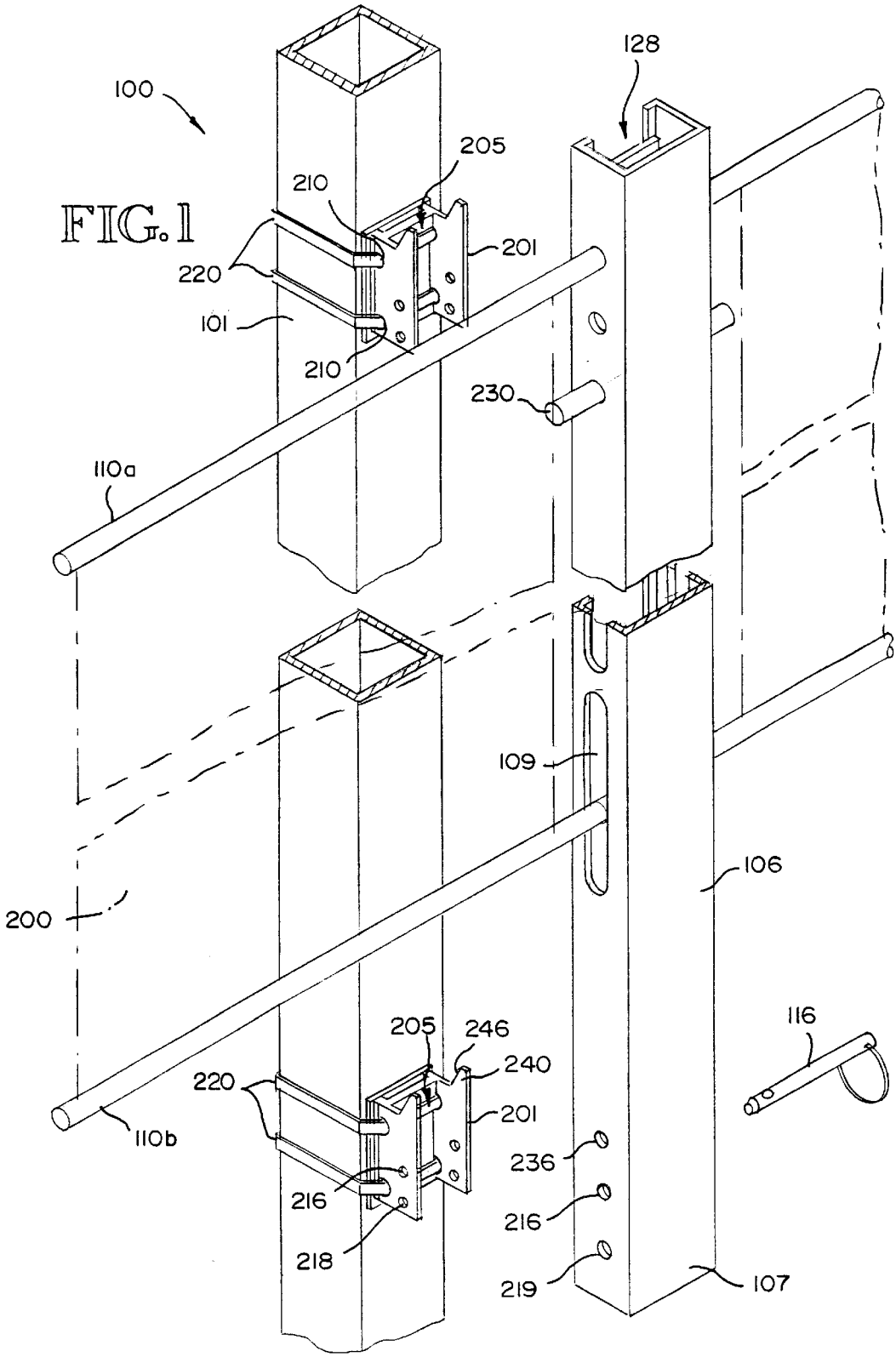
FIG. 1 is a schematic front perspective view of a preferred embodiment of a banner holder according to the invention.

Turning now to the drawings, the invention will be described in a preferred embodiment by reference to the numerals of the drawing figures wherein like numbers indicate like parts.

Figure 3A:
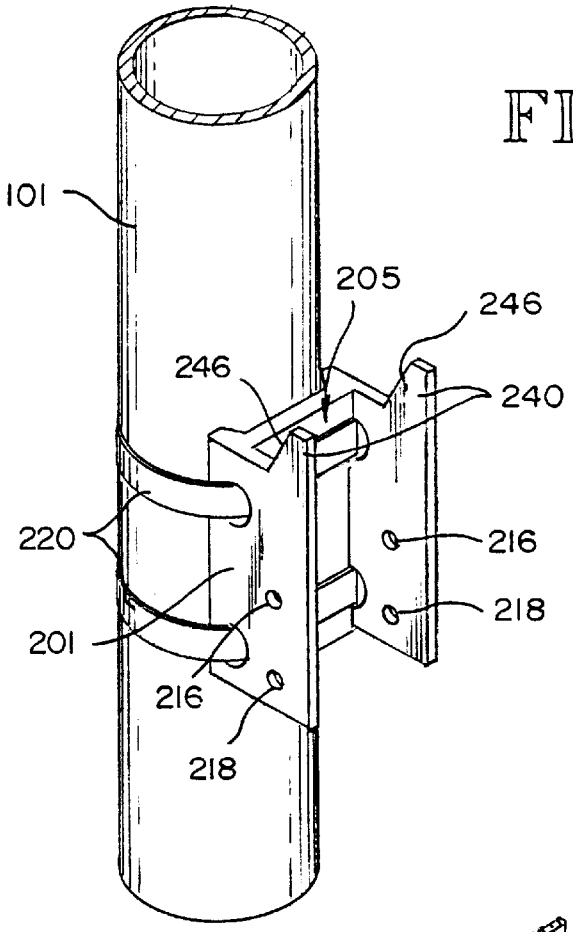
FIGS. 3*a* and 3*b* are schematic front perspective views of the formed mount.
Figure 3B:
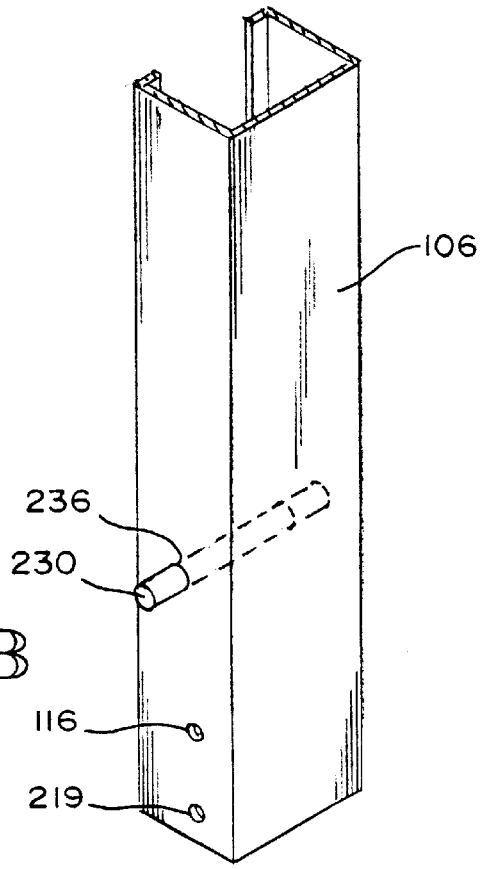

FIG. 1 is a schematic front perspective view of a preferred embodiment of a banner holder according to the invention comprising a formed mount employing a tapered structure to removably retain the banner holder. The banner holder 100 comprises support member 101, at least one formed mount 201, brace 106, and a pair of frame members 110 which support banner 200. Support member 100 serves to hold the banner and the remaining parts of the banner holder in a position in which banner 200 may be displayed, as for example by standing in a substantially vertical position at a distance above the ground sufficient to support the banner within the view of a passing viewer. Such a position is referred to herein as a display position, and comprises any position adapted for the display of the banner, as for example a substantially flat, extended disposition approximating the planar or a smoothly curved surface, which allows for viewing of a substantial portion of the banner. Thus the primary function of the support member 101 is to hold the formed mount 201, and if more than one formed mount 201 is used, to hold the formed mounts 201 a sufficient distance apart and with sufficient strength to permit them to perform their job of supporting brace 106. Any means of holding the support member in place, and any support member orientation, which will allow it to accomplish these purposes will serve. For example, the support member may be held in place by a number of folding legs, like a portable music stand, or by a heavy block (e.g. concrete) attached to its bottom, or it may be sunk permanently into the ground or other foundation. Similarly, instead of comprising a single upright member, the support member may comprise two or more horizontal (or otherwise oriented) members adapted to hold two formed mounts 201 in place and a suitable distance apart for the purposes described herein. The support member 101 can comprise a surface, such as a wall or ceiling. The formed mount 201 is removably attached to the support member 101 by any appropriate means, including strap mounting apparatus 220, or common bolts and nuts, or U-bolts and nuts which are not depicted, all of which may pass through openings for mounting apparatus 210. FIGS. 3–5 show the specific details of the formed mount 201, and FIG. 1 shows its general configuration. The formed mount 201 has a receiver 205 for the brace 106, and at least one tapered structure 240 with a guide face 246, said guide face 246 angles toward the support member as it runs from the outboard end of the tapered structure toward the body of the formed mount. The formed mount 201 optionally has an opening for insertion of a retention apparatus 216 and an opening for insertion of a locking apparatus 218. The portion of the brace 106 intended for placement in the receiver 205 of mounting apparatus 201 has a brace mounting pin 230 located in the brace mounting pin opening 236. The cross section of the receiver 205, and the cross section of the brace 106 where it engages the receiver, are adapted to hold the brace 106 approximately rigid in the formed mount 201. The brace end 107 optionally has an opening for insertion of a retention apparatus 116 and an opening for insertion of a locking apparatus 219.

The brace mounting pin 230 is typically but not necessarily located proximate to the end 107 of the brace 106. The brace mounting pin 230 is mounted in the opening for brace mounting pin 236 in any appropriate manner. The brace mounting pin 230 can be any appropriate diameter, and any length sufficient to engage the brace 106 and the guide face 246.

This preferred embodiment can be practiced using one or more formed mounts. If the invention is practiced using only one formed mount, the brace 106 is placed in the receiver 205 and generally against the support member 101, with the brace mounting pin 230 above the tapered structure 240 and guide face 246. The brace 106 with the brace mounting pin 230 is moved toward and then against the guide face 246. Movement is continued until the brace 106 is drawn against the formed mount 201 and lies in close proximity to the support member 101, and thereby securing and retaining the brace 106 against the support member 101. A retaining pin 116 optionally can be inserted into the openings 216. A locking apparatus can be optionally be inserted into openings 218 and 219 to inhibit unauthorized removal. The opening for the brace mounting pin 236 can be located at any appropriate location along the length of the brace, and does not need to be at an end.

A second mount can be used in conjunction with this alternative embodiment invention. The second mount can be any type of mount that will retain the brace in appropriate proximity to the support column 101, and that will allow the first formed mount 201 to secure and retain the brace 106 as described above. The second mount can be any suitable type, or it can be a second formed mount. In this embodiment, formed mounts 201 are particularly well suited to the simple and efficient replacement and removal of banners from the frames themselves, thus supplementing the purpose and function of the brace members in permitting rapid removal and replacement of banners through the use of distinct banners mounted on separate braces.

Figure 2:
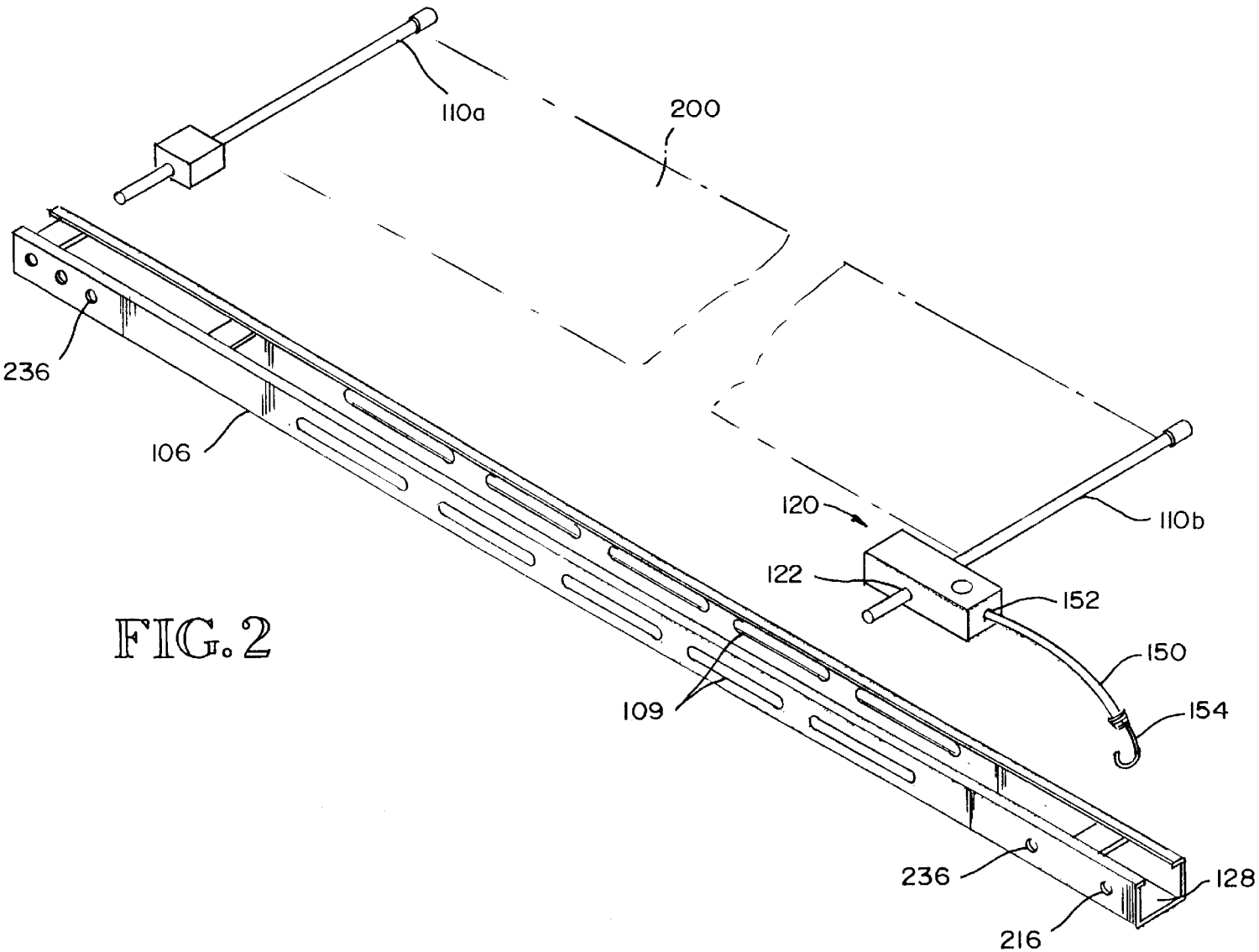
FIG. 2 is a schematic front perspective view of the banner holder assembly.

FIG. 2 depicts the brace 106 with a banner 200 held on opposite sides by a pair of frame members 110. The first frame member 110*a* is removably attached to the brace 106 in a manner to hold it perpendicular to the brace 106. At least one channel 128 is formed in the brace 106 to slidably engage and retain moveable mount 120. FIG. 2 depicts the channel 128 as internal, but it can be formed on an external surface of the brace 106. The moveable mount 120 is shaped such that it can freely move within the channel 128, but is retained within the channel 128. The second frame member 110*b* is attached to the movable mount 120. The banner 200 is removably attached to the frame members 110 along opposite edges by attaching two ends of one side to the first frame member 110*a* and the remaining two ends to the second frame member 110*b*. The first end 152 of an elastic member 150 is attached to the moveable mount 120, and the second end 154 is attached to the brace 106 at a convenient location. The elastic properties of the elastic member 150 are selected to provide the desired tension on the banner 200. The banner 200 is held taut by the force of the elastic member 150, and the second frame member 110*b* is allowed to move toward the first frame member 110*a* when the banner is subject to wind loads. The elastic member 150 can load the moveable mount 120 by either expansion or contraction. In the preferred embodiment, the elastic member 150 loads the moveable member 120 by contraction, and can be a spring or any elastomer material, including but not limited to what is commonly known as a shock cord.

In an alternative embodiment of the banner support assembly 104, the brace 106 has at least one pair of opposed slots 109. The moveable mount 120 has an aperture 122 orientated to align with said pair of opposed slots 109 and is of sufficient diameter to receive the second frame member 110*b*. The moveable mount 120 is inserted into the channel 128 of brace 106, and placed in the vicinity of the pair of opposed slots 109. The second frame member 110*b* is inserted through the aperture 122 and the pair of opposed slots 109 to retain the moveable mount 120 in the channel 128, and limit the distance the movable mount 120 can slide to the length of the pair of opposed slots 109. Several pair of opposed slots 109 can be formed in series in the brace 106 to provide a range of locations for various banner sizes.

FIGS. 3A, 3B, 4 and 5 show the details of the formed mount employing a tapered structure to removably retain the banner. The formed mount 201 is removably attached to the support member 101 by any appropriate means, including strap mounting apparatus 220, which may pass through openings for mounting apparatus 210. The formed mount 201 has a receiver 205 for the brace 106, and at least one tapered structure 240 with a guide face 246, said guide face 246 angles toward the support member as it runs from the outboard end of the tapered structure toward the body of the formed mount. The formed mount 201 optionally has an opening for insertion of a retention apparatus 216 and an opening for insertion of a locking apparatus 218. The portion of the brace intended for placement in the receiver 205 of mounting apparatus 201 has a brace mounting pin 230 located in the brace mounting pin opening 236. The cross section of the receiver 205, and the cross section of the brace 106 where it engages the receiver, are adapted to hold the brace 106 approximately rigid in the formed mount 201. The brace end 107 optionally has an opening for insertion of a retention apparatus 116 and an opening for insertion of a locking apparatus 219.

The brace mounting pin 230 is typically but not necessarily located proximate to the end 107 of the brace 106. The brace mounting pin 230 is mounted in the opening for brace mounting pin 236 in any appropriate manner. The brace mounting pin 230 can be any appropriate diameter, and any length sufficient to engage the brace 106 and the guide face 246. The rectangular tube provides torsional rigidity to inhibit the banner 200 rotating around the brace 106. The opening for brace mounting pin 236 is located laterally in the brace 106 such that a brace mounting pin 230 inserted therein will easily contact the guide face upon initial placement in the receiver 205, and will not bottom out against the body of the formed mount 201 before the brace 106 is fully drawn against the support member 101. The opening 236 in the brace 106 for a retention apparatus 116 and opening for insertion of a locking apparatus 219 are located on the brace 106 linearly and laterally to align with retention opening 216 and optional opening for locking apparatus 218 located in the mount 201 when the brace 106 is fully drawn against the support member 101.

The preferred embodiment can be practiced using one or more mounts. If the invention is practiced using only one formed mount, the brace 106 is placed in the receiver 205 and generally against the support member 101, with the brace mounting pin 230 above the tapered structure 240 and guide face 246. The brace 106 with the brace mounting pin 230 is moved toward and then against the guide face 246. Movement is continued until the brace 106 is drawn against the formed mount 201 and lies in close proximity to the support member 101, and thereby securing and retaining the brace 106 against the support member 101. A retaining pin 117 optionally can be inserted into the openings 216 and 116. A locking apparatus can be optionally be inserted into openings 218 and 219 to inhibit unauthorized removal. The opening for the brace mounting pin 236 can be located at any appropriate location along the length of the brace, and does not need to be at an end. Once the brace member 106 has been placed in the display position (i.e. with its ends in place in the two mounting members, as described), retaining pin 116 is placed in retention holes 216 and secured as desired. The retaining pin may be a simple pin, a cotter pin, or a bolt. If there is a significant risk of undesired removal of the banner from the support member, a conventional pad lock may be used as the locking apparatus and inserted through openings 218 and 219.

EXAMPLE

An example of the banner holder 100 was successfully built. An example was successfully built using a 0.5 inch diameter brace mounting pin 230 and rectangular aluminum tube for the brace 106. The banner support member 101 was built by cutting a channel 128 the length of the rectangular aluminum tube used for brace 106. Crosspieces were placed across the channel at the ends, and an intermediate location to strengthen the brace 106. In the alternative, preformed tube could be used. Five pairs of approximately 10" long×+½" diameter opposed slots 109 were cut into the brace 12" apart, beginning approximately three feet from the aperture 121 for the first frame member 110*a*. Three apertures 121 having +⅝" diameter were drilled to provide a range of adjustment in the first portion of the brace 106. A square, fixed top block matching the cross section of the brace 106 and having a ¾" aperture to receive the first frame member 110*a* was placed in the channel 128 and the apertures were aligned. The first fame member 110 made of ⅝" aluminum tube was inserted into the aligned apertures 121. The square, fixed block and the pair of opposing apertures 121 hold the first frame member 110*a* against torque. The moveable mount 120, matching the cross section of the brace 106 and about three times longer than the width of the brace 106 cross section, and having a +½" aperture to receive the second fame member 110 was placed in the channel 128. The aperture in the moveable mount 120 was aligned with the appropriate pair of opposed slots for the banner. The second frame member 110*b* made of ½" aluminum tube was inserted into the selected, opposed slots and aperture in the moveable mount 120. Lateral movement of both frame members 110 is restrained by cotter pins inserted in holes in the frame members 110 adjacent to the brace, which are not shown. A bungee or shock cord functioned as the elastic member 150. The first end 152 is attached to the moveable mount 150. The banner 200 is then attached along one side to the first frame member 110*a*, and then along the other side to the second frame member. The second end 154 of the bungee cord (elastic member 150) is attached to a convenient point on the brace to provide the desired tension on the banner.

Rectangular aluminum tube was used for the brace 106, and a 0.5 inch diameter brace mounting pin 230 was used. The rectangular tube provides torsional rigidity to inhibit the banner 200 rotating around the brace 106. The opening for brace mounting pin 236 is located laterally in the brace 106 such that a brace mounting pin 230 inserted therein will easily contact the guide face upon initial placement in the receiver 205, and will not bottom out against the body of the formed mount 201 before the brace 106 is fully drawn against the support member 101. The optional opening for a retention apparatus 116 and opening for insertion of a locking apparatus 219 are located on the brace linearly and laterally to align with optional retention opening 216 and optional opening for locking apparatus 218 located in the mount 201 when the brace 106 is fully drawn against the support member 101.

The banner holder according to the invention may be employed either in the vertical orientation shown in the Figures, in a horizontal orientation, or in any other desired orientation, a particular advantage of employing it in the vertical orientation shown is that it is held quite securely in place, once the brace has been mounted, by the force of gravity. In those embodiments of the invention comprising the retention means described herein, use of the retention means in conjunction with a stop, as described, provides a very secure assembly.

As will appear to those familiar with the art of standard making and banner display, particulars such as the cross sections of the various components described herein are largely immaterial. For example, the support, brace, and frame members may be of circular, square, or other common cross-sectional shape, solid, tubular, or hollow, or of any other section not inconsistent with the purposes described herein. Likewise, while generally preferred embodiments of the invention are fabricated from metal, wood, or plastic materials, such as steel, aluminum, or polyvinyl chloride (PVC), any materials of sufficient strength, durability, and corrosion-resistant properties for specific applications will serve, the proper selection of such materials being well within the skill of ordinary designer of such systems.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABLITY

The invention provides improvements for holding fixtures, and more particularly for banner and sign display devices. In particular, the invention provides secure simplified means for permanent or temporary mounting and display of banners and other devices. The invention further provides a system for protecting banners from wind damage by the allowing the banner support assembly to respond the wind loads by reducing the effective area of the banner, and to spill the wind.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A banner support assembly for holding a banner taut, said banner support assembly comprising:

a. a first and a second frame member that hold the banner along its opposite sides;

b. said first frame member removably attached to a brace in a manner to hold said first frame member perpendicular to the brace;

c. said second frame member slidably positioned within said brace;

d. said brace comprising:

i. a first portion to which the first frame member is attached; and ii. a second portion adapted to slidably engage a moveable mount that is attached to said second frame member.

e. said moveable mount, to which the second frame member is attached; and f. a means for tensioning the banner by increasing the distance between the first frame member and the moveable mount to which the second frame member is attached until desired tension of the banner is achieved;

whereby, the banner is held taut in the banner support assembly and is able to move and spill wind to limit damage to the banner.

2. A banner support assembly for holding a banner taut, said banner support assembly comprising:

a. a first and a second frame member that hold the banner along its opposite sides;

b. said first frame member removably attached to a brace in a manner to hold said first frame member perpendicular to the brace;

c. said second frame member slidably positioned within said brace;

d. said brace comprising:

i. a first portion to which the first frame member is attached; and ii. a second portion adapted to slidably engage a moveable mount that is attached to said second frame member;

e. said moveable mount, to which the second frame member is attached; and f. an elastic member, attached at its first end to the moveable mount and at its second end to a fixed point, to tension the banner by increasing the distance between the first frame member and the moveable mount to which the second frame member attached;

whereby, the banner is held taut in the banner support assembly, and the second frame member is able to move and spill wind to limit damage to the banner.

3. The banner support of claim 2, where the channel is inside the brace.

4. The banner support of claim 2, where the elastic member is an elastomer material.

5. The banner support of claim 2, where the brace has at least one pair of opposed slots, where the moveable mount has an aperture orientated to align with one said pair of opposed slots, and both the slots and aperture are sized to accept the second frame member, such that when the moveable mount is inserted into the channel and the second frame member is inserted through the slots and the aperture, the moveable mount is retained in the channel and the distance the moveable mount can slide is limited by the length of the slots.

6. A banner support assembly for holding a banner taut, said banner support assembly comprising:

a. a first and a second frame member that hold the banner along its opposite sides;

b. said first frame member removably attached to a brace in a manner to hold said first frame member perpendicular to the brace;

c. said second frame member slidably positioned within said brace;

d. said brace comprising:

i. a first portion having an aperture into which the first frame member is inserted; and ii. a second portion comprising at least one pair of opposed slots and a channel that slidably engages a moveable mount.

e. said moveable mount having an aperture orientated to align with said pair of opposed slots, into which the second frame member is inserted, such that when the moveable mount is slidably engaged in the channel and the second frame member is inserted through the pair of slots and the aperture, the moveable mount is retained in the channel and the distance the moveable mount can slide is limited by the length of the slots; and f. an elastic member having a first end and a second end, attached at its first end to the moveable mount and at its second end to a fixed point, to tension the banner by increasing the distance between the first frame member and the moveable mount to which the second frame member attached;

whereby, the banner is held taut in the banner support assembly, and the second frame member is able to move and spill wind to limit damage to the banner.

7. The banner support of claim 6, where the channel is formed within the brace.

8. The banner support of claim 6, where the elastic member is an elastomer material.

9. A method for supporting and holding a banner taut comprising:

a. holding a banner along its opposite sides by a first and a second frame member;

b. providing for said first frame member to be removably attached to a brace in a manner to hold said first frame member perpendicular to the brace;

c. providing for said second frame member to be slidably positioned within said brace;

d. said brace comprising:

i. a first portion into which the first frame member is attached by insertion into an aperture; and ii. a second portion comprising at least one pair of opposed slots and a channel that slidably engages a moveable mount;

e. providing for said moveable mount to have an aperture orientated to align with said pair of opposed slots, into which the second frame member is inserted, such that when the moveable mount is slidably engaged in the channel and the second frame member is inserted through the pair of slots and the aperture, the moveable mount is retained in the channel and the distance the moveable mount can slide is limited by the length of the slots; and f. attaching an elastic member that has a first end and a second end, by its first end to the moveable mount, and by its second end to a fixed point on said brace in such a manner as to tension the banner by increasing the distance between the first frame member and the moveable mount to which the second frame member attached until the desired tension of the banner is achieved;

whereby, the banner is held taut between the first and second frame members, and the second frame member is able to move and the banner is limited.

10. The banner support assembly of claim 9, where the channel is formed within the brace.

11. A banner holder for holding a banner in a display position, the holder comprising:

a banner support assembly for holding a banner taut, said banner support assembly comprising:

a. a first and a second frame member that hold the banner along its opposite sides;

b. said first frame member removably attached to a brace in a manner to hold said first frame member perpendicular to the brace;

c. said second frame member slidably positioned within said brace;

d. said brace comprising:

i. a first portion to which the first frame member is attached; and ii. a second portion that slidably engages a moveable mount that is attached to said second frame member;

e. said moveable mount, to which the second frame member is attached; and f. a means for tensioning the banner by increasing the distance between the first frame member and the moveable mount to which the second frame member is attached until desired tension of the banner is achieved;

a support member with at least one mounting member attached; said brace, a portion thereof adapted to engage said mounting member and having a brace mounting pin; and said mounting member having a brace receiver adapted to accept said brace and having at least one structure formed to draw said brace mounting pin toward said support member as the brace is place into said brace receiver;

whereby, when said brace is placed into said receiver in the mounting member to an extent sufficient for said brace mounting pin to draw the brace against said support member, the brace is thereby secured and retained to the support member, and whereby, the banner is held taut in the banner support assembly and the second frame member is able to move and spill wind such that damage to the banner is limited.

12. The banner holder of claim 11, wherein at least one portion of said brace includes a retention means adapted to prevent the brace from being withdrawn from the receiver in said mounting member.

13. The banner holder of claim 12, wherein said retention means includes a hole disposed in said brace and a retaining pin.

14. A banner holder for holding a banner in a display position, the holder comprising:

a banner support assembly for holding a banner taut, said banner support assembly comprising:

a. a first and a second frame member that hold the banner along its opposite sides;

b. said first frame member removably attached to a brace in a manner to hold said first frame member perpendicular to the brace;

c. said second frame member slidably positioned within said brace;

d. said brace comprising:

i. a first portion to which the first frame member is attached; and ii. a second portion that slidably engages a moveable mount that is attached to said second frame member;

e. said moveable mount, to which the second frame member is attached; and f. an elastic member having a first end and a second end, attached at its first end to the moveable mount and at its second end to a fixed point, to tension to banner by increasing the distance between the first frame member and the moveable mount with the second frame member attached;

a support member with a first mounting member and a second mounting member attached;

a first mounting portion of the brace adapted to engage said first mounting member and having a first brace mounting pin;

a second mounting portion of the brace adapted to engage said second mounting member;

said first mounting member having at least one brace receiver adapted to accept said first mounting portion of the brace and having at least one structure formed to draw said first brace mounting pin toward said support member as the first mounting portion of the brace is engaged into said first mounting member brace receiver;

said second mounting member having a second brace receiver formed to accept the second mounting portion of the brace and retained in the brace in proximity to the support member; and said second mounting member being disposed upon the support member at a distance from the first mounting member sufficient to allow the second mounting portion of the brace to be placed in said second brace receiver in the second mounting member and inserted therein to an extent sufficient to allow the first mounting portion of the brace to be aligned with and placed in said first receiver in the first mounting g member without disengaging said second mounting portion of the brace from said second mounting member;

whereby, when said second mounting portion of the brace is placed into said receiver in the second mounting member, and said first mounting portion of the brace is placed into said receiver in the second mounting member to an extent sufficient for said brace mounting pin to draw the brace against said support structure, the brace is thereby secured and retained to the support member, and further whereby, the banner is held taut in the banner support assembly, and the second frame member is able to move and spill wind to limit damage to the banner.

15. A banner holder for holding a banner in a display position, said banner holder comprising:

a. a first and a second frame member that hold the banner along its opposite sides;

b. said first frame member removably attached to a brace in a manner to hold said first frame member perpendicular to the brace;

c. said second frame member slidably positioned within said brace;

d. said brace comprising:

i. a first portion having an aperture into which the first frame member is inserted; and ii. a second portion comprising at least one pair of opposed slots and a channel that slidably engages a moveable mount;

e. said moveable mount having an aperture orientated to align with said pair of opposed slots, into which the second frame member is attached by insertion into said apurture, such that when the moveable mount is slidably engaged in the channel and the second frame member is inserted through the pair of slots and the aperture, the moveable mount is retained in the channel and the distance the moveable mount can slide is limited by the length of the slots; and f. an elastic member having a first end and a second end, attached at its first end to the moveable mount, and at its second end to a fixed point in such a manner as to tension the banner by increasing the distance between the first frame member and the moveable mount to which the second frame member attached until the desired tension of the banner is achieved;

a support member, with a first mounting member and a second mounting member attached to said support member;

a first mounting portion of the brace adapted to engage said first mounting member and having a first brace mounting pin;

a second mounting portion of the brace adapted to engage said second mounting member and having a second brace mounting pin;

said first mounting member having at least one brace receiver adapted to accept said first mounting portion of the brace and having at least one structure formed to draw said first brace mounting pin toward said support member as the first mounting portion of the brace is engaged into said first mounting member brace receiver;

said second mounting member having at least one brace receiver adapted to accept said second mounting portion of the brace and having at least one structure formed to draw said second brace mounting pin toward said support member as the second mounting portion of the brace is engaged into said second mounting member brace receiver; and said second mounting member being disposed upon the support member at a distance from the first mounting member sufficient to allow the first and second mounting portions of the brace to be placed in their respective brace receivers in their respective mounting members, and inserted therein to an extent sufficient to allow the brace mounting pins to draw the brace against said mounting members and proximate to the banner support assembly;

whereby, the brace is thereby secured and retained to the support member, and the banner is held taut in the banner support assembly and the second brace is able to move and spill wind such that damage to the banner is limited;

whereby, the banner is held taut in the banner support assembly, and the second frame member is able to move and spill wind to limit damage to the banner.

16. The banner holder of claim 15, wherein at least one end of said brace includes a retention means adapted to prevent the brace from being withdrawn from the receiver in said mounting member.

17. The banner holder of claim 16, wherein said retention means includes a hole disposed in said brace and a retaining pin.

18. A method for holding a banner taut in a display position, the method comprising:

a. holding a banner along its opposite sides by a first and a second frame member;

b. providing for said first frame member to be removably attached to a brace in a manner to hold said first frame member perpendicular to the brace;

c. providing for said second frame member to be slidably positioned within said brace;

d. said brace comprising:

i. a first portion into which the first frame member is attached by insertion into an aperture; and ii. a second portion comprising at least one pair of opposed slots and a channel that slidably engages a moveable mount;

e. providing for said moveable mount to have an aperture orientated to align with said pair of opposed slots, into which the second frame member is inserted, such that when the moveable mount is slidably engaged in the channel and the second frame member is inserted through the pair of slots and the aperture, the moveable mount is retained in the channel and the distance the moveable mount can slide is limited by the length of the slots; and f. attaching an elastic member that has a first end and a second end, by its first end to the moveable mount, and by its second end to a fixed point on said brace in such a manner as to tension the banner by increasing the distance between the first frame member and the moveable mount to which the second frame member attached until the desired tension of the banner is achieved;

attaching first and second mounting members to a support member;

providing a first mounting portion of the brace to engage said first mounting member, including a first brace mounting pin;

providing a second mounting portion of the brace to engage said second mounting member, including a second brace mounting pin;

providing said first mounting member with a brace receiver adapted to accept said first mounting portion of the brace and having at least one structure formed to draw said first brace mounting pin toward said support member as the first mounting portion of the brace is engaged into said first mounting member brace receiver;

providing a second mounting member with a brace receiver adapted to accept said second mounting portion of the brace and having at least one structure formed to draw said second brace mounting pin toward said support member as the second mounting portion of the brace is engaged into said second mounting member brace receiver;

disposing said second mounting member upon the support member at a distance from the first mounting member sufficient to allow the first and second mounting portions of the brace to be placed in their respective brace receivers in their respective mounting members; and inserting the brace into the mounting members to an extent sufficient to allow the brace mounting pins to draw the brace against said mounting members and proximate to the support structure;

whereby, the brace is thereby secured and retained to the support member, the banner is held taut in the banner support assembly and the second brace is able to move and spill wind such that damage to the banner is limited.

19. The method of claim 18, wherein at least one portion of said brace includes a retention means adapted to prevent the brace from being withdrawn from the receiver in said mounting member.

* * * * *